US009915913B2

(12) United States Patent
Takahata et al.

(10) Patent No.: US 9,915,913 B2
(45) Date of Patent: Mar. 13, 2018

(54) COVER FOR IMAGE FORMING APPARATUS

(71) Applicant: CANON KABUSHIKI KAISHA, Tokyo (JP)

(72) Inventors: Kazuaki Takahata, Kawasaki (JP); Katsunori Yokoyama, Suntou-gun (JP); Shinji Yamamoto, Kawasaki (JP); Rie Endo, Yokohama (JP); Kazumasa Shibata, Kawasaki (JP); Hiroki Kasama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/275,700

(22) Filed: Sep. 26, 2016

(65) Prior Publication Data

US 2017/0097606 A1 Apr. 6, 2017

(30) Foreign Application Priority Data

Oct. 5, 2015 (JP) ..... 2015-197956

(51) Int. Cl.

| | |
|---|---|
| ***G03G 21/16*** | (2006.01) |
| *G10K 11/172* | (2006.01) |
| *G10K 11/04* | (2006.01) |

(52) U.S. Cl.

CPC ..... *G03G 21/1619* (2013.01); *G10K 11/04* (2013.01); *G10K 11/172* (2013.01)

(58) Field of Classification Search

CPC ..... G03G 21/1619; G03G 2221/1678; G10K 11/04; G10K 11/16; G10K 11/172; H05K 5/00

See application file for complete search history.

(56) References Cited

U.S. PATENT DOCUMENTS

| | | | | |
|---|---|---|---|---|
| 2012/0234625 | A1* | 9/2012 | Laugharn, Jr. ..... | G10K 11/28 181/140 |
| 2016/0225363 | A1* | 8/2016 | Ishida ..... | G10K 11/172 |
| 2016/0273605 | A1 | 9/2016 | Endo et al. | |
| 2016/0273611 | A1 | 9/2016 | Endo et al. | |
| 2016/0273612 | A1 | 9/2016 | Endo et al. | |
| 2017/0221469 | A1* | 8/2017 | Ishida ..... | G10K 11/168 181/211 |

FOREIGN PATENT DOCUMENTS

| | | | |
|---|---|---|---|
| JP | 2002-365985 | A | 12/2002 |
| JP | 2012-122236 | A | 6/2012 |
| JP | 5209037 | B2 | 6/2013 |

OTHER PUBLICATIONS

U.S. Appl. No. 15/189,008, filed Jun. 22, 2016.

* cited by examiner

*Primary Examiner* — David M Gray
*Assistant Examiner* — Laura Roth
(74) *Attorney, Agent, or Firm* — Fitzpatrick, Cella, Harper & Scinto

(57) ABSTRACT

An image forming apparatus includes a main body, a cover, a driving unit, and a film. The main body is configured to accommodate an image forming portion which forms an image on a recording material. The cover is provided on the main body and covers the image forming portion. The driving unit is provided on the main body and drives the image forming portion. The film is attached to the cover with a gap formed against an inner wall of the cover. The film faces the inner wall of the cover while a tension is given thereto and without coming into contact with the driving unit.

7 Claims, 16 Drawing Sheets

COVER FOR IMAGE FORMING APPARATUS

BACKGROUND OF THE INVENTION

Field of the Invention

The present invention relates to an image forming apparatus including a cover that covers an apparatus main body of the image forming apparatus.

Description of the Related Art

An image forming apparatus, such as a copying machine, uses components, such as a laser scanner unit, a motor, a solenoid, and a clutch, operating intermittently or constantly during image formation. These components generate some sounds when these components operate. In addition, due to the vibration generated by these components, surrounding components may resonate and generate sounds. Further, the image forming apparatus also generates sounds due to rubbing, buckling, hitting (collision), and the like of sheets when sheets such as recording sheets are conveyed.

Most of the sounds generated in such apparatus operation include many frequency components equal to or less than about 1 kHz, and the operator of the apparatus and those around the apparatus may feel that these are extremely disturbing noises depending on the magnitude of the sound pressure level at that frequency band. Therefore, a countermeasure is taken to reduce the noises by suppressing the noises themselves generated in the apparatus or preventing the noises generated in the apparatus from leaking to the outside of the apparatus. The countermeasure for preventing the sounds from leaking to the outside of the apparatus is usually performed by shielding the sound with an external cover. In general, a resin material is employed as the external cover from the viewpoint of weight reduction and cost reduction.

Under such circumstances, Japanese Patent Laid-Open No. 2002-365985 discloses a technique for achieving sound insulation by adhering a fibrous acoustic material having a sound absorption function in an audible sound frequency region on an inner surface of an external cover enclosing an apparatus main body.

Further, Japanese Patent Laid-Open No. 2012-122236 discloses a technique for achieving sound insulation by increasing the rigidity of a sealed pouch (sound insulation member) by having the sealed pouch (sound insulation member) made of a flexible thin film material sandwiched and supported by a pair of lattice-shaped frame bodies.

However, in the technique of Japanese Patent Laid-Open No. 2002-365985, the external cover becomes thicker since the acoustic material is used. In the technique in Japanese Patent Laid-Open No. 2012-122236, the lattice-shaped frame body is used to fix the sealed pouch (sound insulation member), and therefore, this also increases the thickness and the weight.

SUMMARY OF THE INVENTION

The present invention is made in view of the above circumstances, and it is desirable to provide an image forming apparatus having a thin cover and still capable of improving the sound insulation property.

A representative configuration of the present invention is an image forming apparatus including: a main body configured to accommodate an image forming portion which forms an image on a recording material; a cover which is provided on the main body and covers the image forming portion; a driving unit which is provided on the main body and drives the image forming portion; and a film attached to the cover with a gap formed against an inner wall of the cover, the film facing the inner wall of the cover while a tension is given thereto and without coming into contact with the driving unit.

Further features of the present invention will become apparent from the following description of exemplary embodiments with reference to the attached drawings.

DESCRIPTION OF THE EMBODIMENTS

Figure 1:
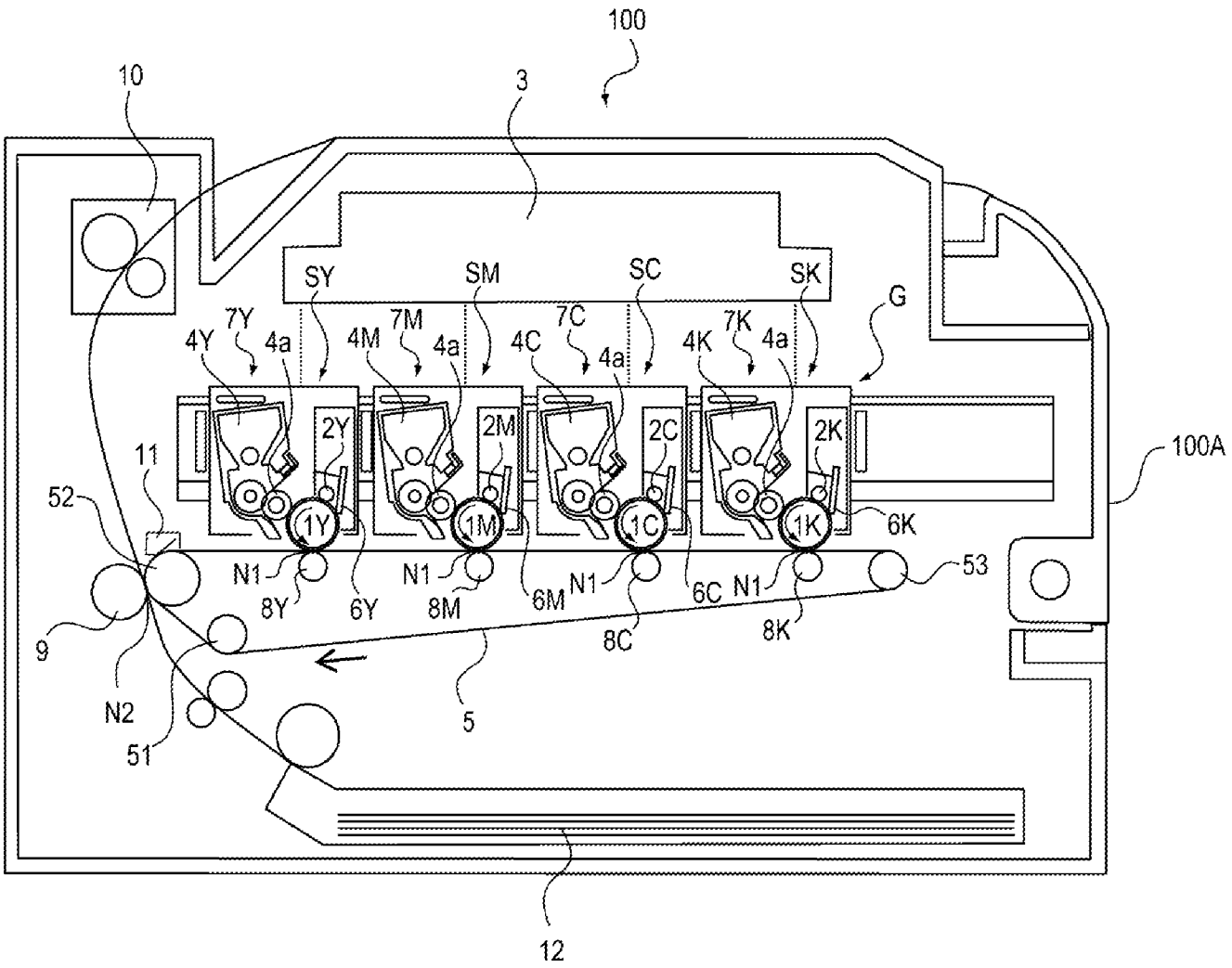
FIG. 1 is a cross sectional view illustrating an image forming apparatus according to a first embodiment.

Hereinafter, modes for carrying out this invention will be described in details in an exemplary manner based on embodiments with reference to drawings. However, a size, a material, a shape, and a relative position thereof described in the embodiments may be changed as necessary in accordance with the configuration and various conditions of the apparatus to which the invention is applied, and therefore, it is to be understood that, unless otherwise specifically described, the scope of the invention is not to be limited thereto. In a configuration of a later embodiment, the same constituent elements as those of a previous embodiment are denoted with the same reference numerals of the previous embodiment, so that the explanations in the previous embodiment are considered to be incorporated therein by reference.

[First Embodiment]

FIG. 1 is a cross sectional view illustrating an image forming apparatus 100 according to the first embodiment of the present invention. The image forming apparatus 100 includes an apparatus main body 100A. Provided inside of the apparatus main body 100A are first, second, third, fourth image forming portions SY, SM, SC, SK serving as multiple image forming portions which form images in the colors of yellow (Y), magenta (M), cyan (C), and black (K).

In the present embodiment, the configurations and the operations of the first to fourth image forming portions SY to SK are substantially the same except that the colors of formed images are different from each other. Therefore, in a case where it is not necessary to particularly distinguish them from each other, subscripts Y, M, C, K attached to the reference symbols are hereinafter omitted in order indicate that it is an element provided for any given color, so that these constituent elements will be described in a generalized manner.

The image forming portions SY, SM, SC, SK include multiple (in this case, four) photosensitive drums 1Y to 1K, respectively, arranged in a horizontal direction. Charging rollers 2Y to 2K, a scanner unit 3, developing units 4Y to 4K, and cleaning members 6Y to 6K are provided around the photosensitive drums 1Y to 1K, respectively. The charging rollers 2Y to 2K uniformly charge the surfaces of the photosensitive drums 1Y to 1K, respectively. Hereinafter, the subscripts Y to K added to the reference symbols will be omitted in the explanation.

The scanner unit 3 forms an electrostatic image by irradiating laser onto the surface of the photosensitive drum 1 based on image information. The developing unit 4 forms a toner image by developing an electrostatic image on the surface of the photosensitive drum 1 with toner. The cleaning member 6 removes toner (transfer residual toner) remaining on the surface of the photosensitive drum 1 after the transfer.

In the present embodiment, the photosensitive drum 1, the charging roller 2 (serving as the process unit exerting on the photosensitive drum 1), the developing unit 4, and the cleaning member 6 are integrally made into a cartridge, so that a cartridge 7 is formed. All the cartridges 7 for the colors have the same shape, and the toners for the colors, i.e., yellow (Y), magenta (M), cyan (C), and black (K), are accommodated in the cartridge 7 (7Y, 7M, 7C, 7K) for the colors, respectively.

An intermediate transfer belt 5 is provided below the four photosensitive drums 1 to transfer the toner image on the surface of the photosensitive drum 1 onto the recording material 12. The intermediate transfer belt 5 is made of an endless belt, and the intermediate transfer belt 5 rotates while coming into contact with the four photosensitive drums 1. The intermediate transfer belt 5 is extended around a driven roller 51, a secondary transfer counter roller 52, and a driving roller 53.

Primary transfer rollers 8 (8Y, 8M, 8C, 8K) are disposed on the inner peripheral surface side of the intermediate transfer belt 5 so as to face the four photosensitive drums 1, respectively. The primary transfer roller 8 presses the intermediate transfer belt 5 toward the photosensitive drum 1, thus forming a primary transfer portion N1 where the intermediate transfer belt 5 and the photosensitive drum 1 are in contact with each other. A bias having a polarity opposite to a normal charging polarity of the toner is applied from a primary transfer bias power supply (a high voltage power supply), not illustrated, to the primary transfer roller 8. As a result, the toner image on the photosensitive drum 1 is transferred onto the intermediate transfer belt 5 (primary transfer).

A secondary transfer roller 9 is arranged at the external peripheral surface side of the intermediate transfer belt 5 so as to face the secondary transfer counter roller 52. The secondary transfer roller 9 is in pressurized contact with secondary transfer counter roller 52 via the intermediate transfer belt 5, thus forming a secondary transfer portion N2 where the intermediate transfer belt 5 and the secondary transfer roller 9 are in contact with each other. A bias having a polarity opposite to a normal charging polarity of the toner is applied from a secondary transfer bias power supply (a high voltage power supply), not illustrated, to the secondary transfer roller 9. As a result, the toner image on the intermediate transfer belt 5 is transferred onto the recording material 12 (secondary transfer).

The recording material 12 having the toner image transferred thereon is conveyed to the fixing apparatus 10. Heat and pressure are applied to the recording material 12 at the fixing apparatus 10, so that the toner image is fixed to the recording material 12. The primary transfer residual toner remaining on the photosensitive drum 1 after the primary transfer step is removed and collected by the cleaning member 6. The secondary transfer residual toner remaining on the intermediate transfer belt 5 after the secondary transfer step is cleaned by an intermediate transfer belt cleaning apparatus 11. It should be noted that the image forming apparatus 100 is configured to be able to use only a desired single or several (not all) image forming portions to form a single color or multi-color image.

Figure 2:
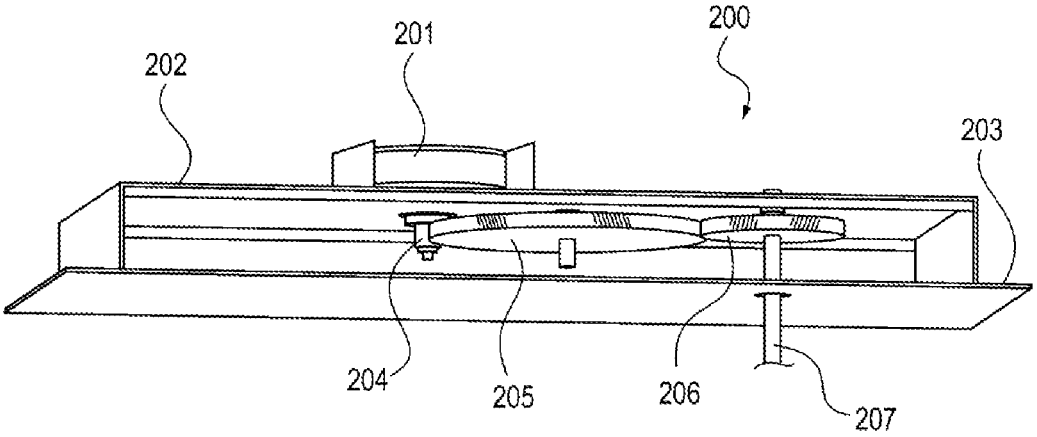
FIG. 2 is a perspective view illustrating an overview of a driving unit.
Figure 3:
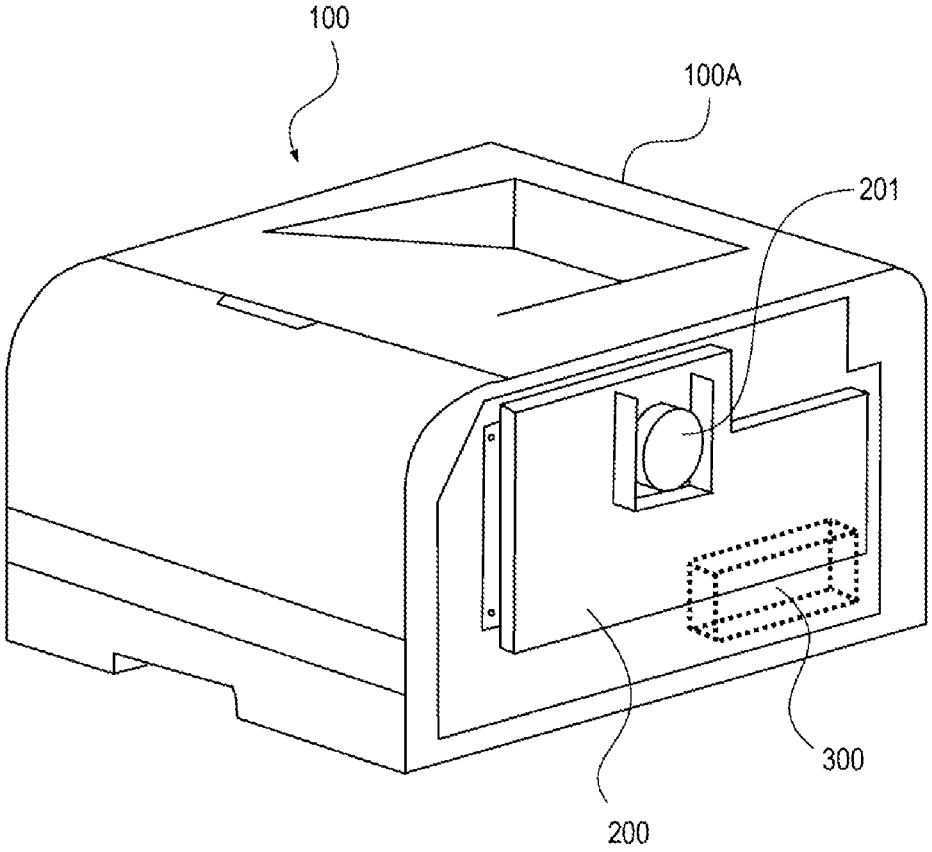
FIG. 3 is a perspective view illustrating an apparatus main body from which an external cover at a side surface of the apparatus main body is detached.

FIG. 2 is a perspective view illustrating an overview of a driving unit 200. FIG. 3 is a perspective view illustrating the apparatus main body 100A from which the external cover 101 (see FIG. 4) at the side surface of the apparatus main body 100A is detached. In a driving unit 200, a driving frame 202 and a main frame 203 is made of a zinc-plated steel plate having a thickness of 1 mm, and the end portions thereof are fastened to the frame of the apparatus main body 100A.

A driving motor 201 is fixed above the driving frame 202, and a pinion gear 204 is coupled with the end of the driving motor 201. It should be noted that the gear train of the pinion gear 204 is engaged with an idle gear 205 and an output gear 206 in order. In addition, the output gear 206 is coupled with an output shaft 207, so that driving can be transmitted to a mechanism inside of the image forming apparatus 100. Depending on the model, many gear trains may be required, and the driving frame 202 is not limited to a single stage, and may have multi-stage configuration.

The driving unit 200 is configured to drive the photosensitive drum 1 and the developing roller 4*a* of the developing unit 4 in the cartridge 7, the primary transfer rollers 8Y to 8K, the secondary transfer roller 9, and the secondary transfer counter roller 52. In addition, the driving unit 200 is also used to drive other driving units such as the fixing apparatus 10 and a feeding driving unit 300. It is known that the driving motor 201 and the gear train in this driving unit 200 become a vibration generation source (oscillation portion), so that the vibration propagates to the frame to generate a frame discharge sound.

Figure 4:
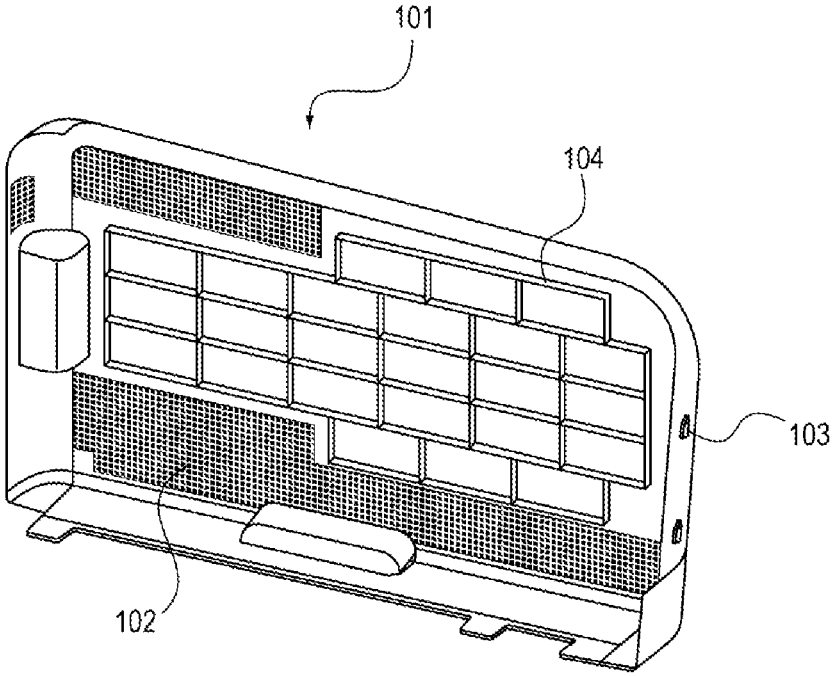
FIG. 4 is a perspective view illustrating a cover main body.

FIG. 4 is a perspective view illustrating the external cover 101. The external cover 101 is produced by molding a resin material. The external cover 101 has a substantially flat surface. The external cover 101 includes an opening portion 102 for passing air discharged from the inside of the apparatus main body 100A or air retrieved from the inside of the apparatus main body 100A. The external cover 101 includes a projection portion 103 for engaging with a frame of the apparatus main body 100A. A rib 104 is formed in the inside of the external cover 101 so as to ensure rigidity, prevent warping, and the like.

In general, the external cover 101 plays a role of achieving sound insulation of sounds generated in the inside due to vibration of the vibration generation source (oscillation portion). The sound transmitted to the outside includes a leakage sound that is leaked from the joint portions of the external cover 101 and the opening portion 102 and a transmission sound transmitted through the external cover 101. In this case, an example of sound insulation characteristics of the external cover 101 at the side of the driving unit 200 of FIG. 3 will be described.

Figure 5:
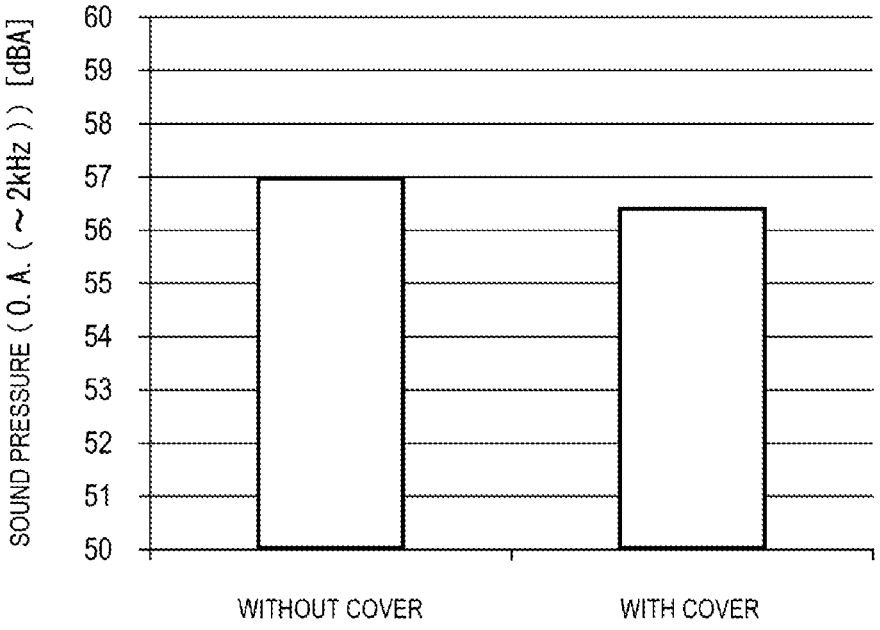
FIG. 5 is a graph illustrating sound pressure level with and without the external cover.

FIG. 5 is a graph illustrating sound pressure level with and without the external cover 101. In this FIG. 5, the sound pressure level of when the image forming apparatus 100 is operated in the monochrome mode is indicated by an overall value (a summation value of each sound pressure level analyzed by frequency) of up to 2 kHz. When the external cover 101 was not provided, the sound pressure level was 57 dBA, and when the external cover 101 was provided, the sound pressure level was 56.5 dBA.

Figure 6:
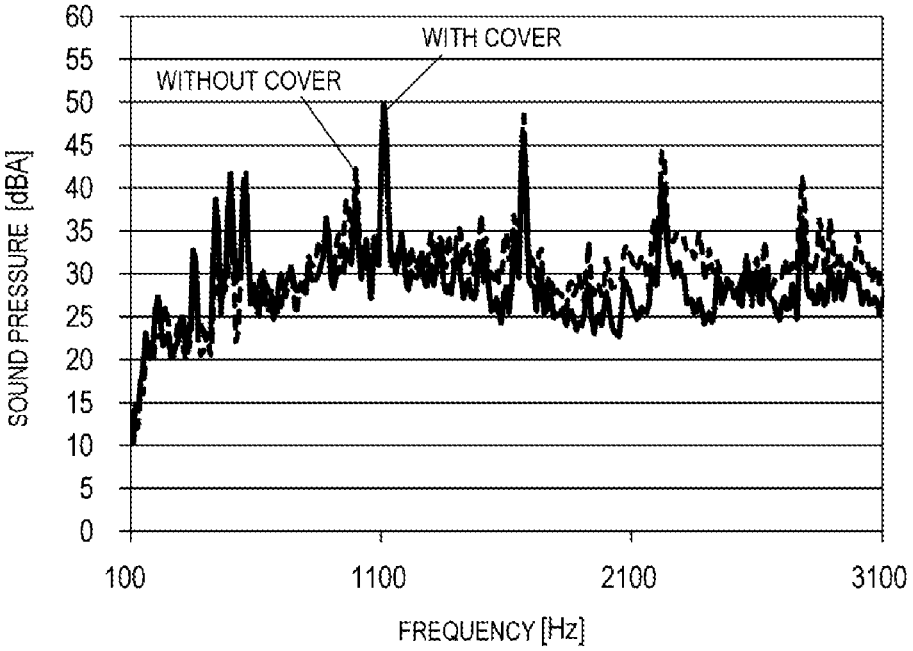
FIG. 6 is a graph illustrating sound pressure levels when a horizontal axis denotes a frequency.

FIG. 6 is a graph illustrating the sound pressure level when the horizontal axis is the frequency. For the measurement of the sound pressure level Pa (dBA) in this measurement, HD Acoustics Camera Array of LMS Test.Lab is used, and installed at a position away from the external cover 101 by 20 cm. Hereinafter, this method was used for the measurement of the sound pressure level.

As illustrated in FIG. 5, the overall value up to 2 kHz was not greatly different between the case where the external cover 101 is provided and the case where the external cover 101 is not provided. The reason why a large difference was not seen as described in FIG. 5 is that, as illustrated in FIG. 6, the peak of the sound pressure level at around 1.1 kHz where the sound pressure level is the highest is not different between the case where the external cover 101 is provided and the case where the external cover 101 is not provided. Further, at the sound pressure peak of a frequency equal to or less than 1.1 kHz, the sound pressure peak tends not to be lower in the case where the external cover 101 is provided. More specifically, it can be seen that a sound of 1.1 kHz or less that is generated in the inside when the image forming apparatus 100 operates is transmitted through the external cover 101.

[External Cover 101 Having Sheet Member 111 According to the Present Invention]

Figure 7A:
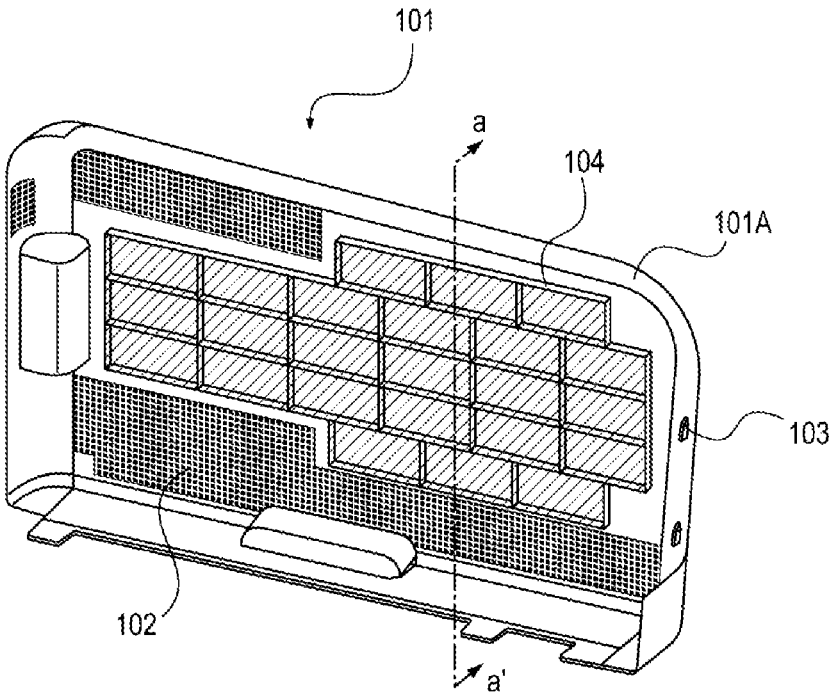
FIG. 7A is a perspective view illustrating an external cover.
Figure 7B:
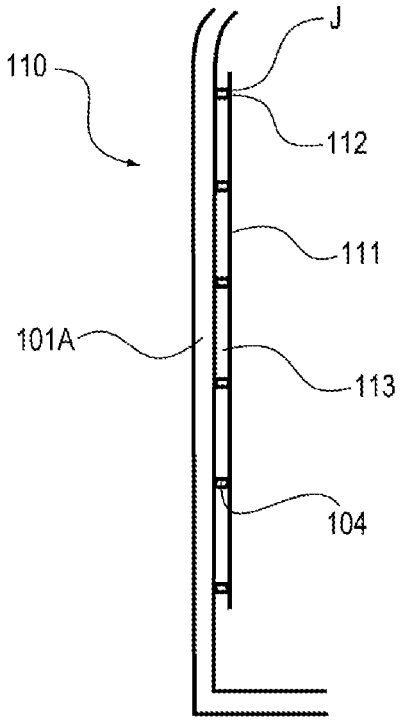
FIG. 7B is a cross sectional view illustrating the external cover.

A configuration of the external cover 101 having the sheet member 111 according to the present invention for reducing the transmission sound of the external cover 101 described above will be described with reference to FIGS. 7A and 7B. FIG. 7A is a perspective view illustrating the external cover 101 having the sheet member 111. FIG. 7B corresponds to a cross sectional view taken along line a-a' of FIG. 7A, and is a cross sectional view illustrating the external cover 101 having the sheet member 111. The external cover 101 serving as a "cover" is a member for covering the apparatus main body 100A of the image forming apparatus 100, and more particularly, the external cover 101 is a member for covering the image forming portion.

The external cover 101 includes a cover main body 101A and a sheet member 111 facing the inner wall of the cover main body 101A with a predetermined distance. A space 113 is ensured between the inner wall of the cover main body 101A and the sheet member 111.

The external cover 101 includes a fixing portion 112 for fixing the inner wall of the cover main body 101A and one end portion and the other end portion of the sheet member 111. Further, the external cover 101 includes a rib 104 serving as a "tension giving portion" for giving tension to the sheet member 111 when the sheet member 111 is fixed to the rib 104. The fixing portion 112 is provided at the end of the rib 104. The sheet member 111 is provided in a non-contact state with the feeding driving unit 300 serving as an "oscillation source" provided in the inside of the apparatus main body 100A (see FIG. 3). The sheet member 111 is formed to have a thickness of 0.2 mm or less.

The sheet member 111 is made of a thin member having flexibility, and is fixed to the fixing portion 112 while a tension is given thereto, so that a predetermined space 113 is formed against a substantially flat surface of the inner wall of the cover main body 101A. More specifically, the sheet member 111 is extended in a film shape and attached, so that a gap is formed between the sheet member 111 and the inner wall of the cover main body 101A. The tension given to the sheet member 111 is preferably equal to or more than 1 kgf/cm and equal to or less than 100 kgf/cm.

Figure 16A:
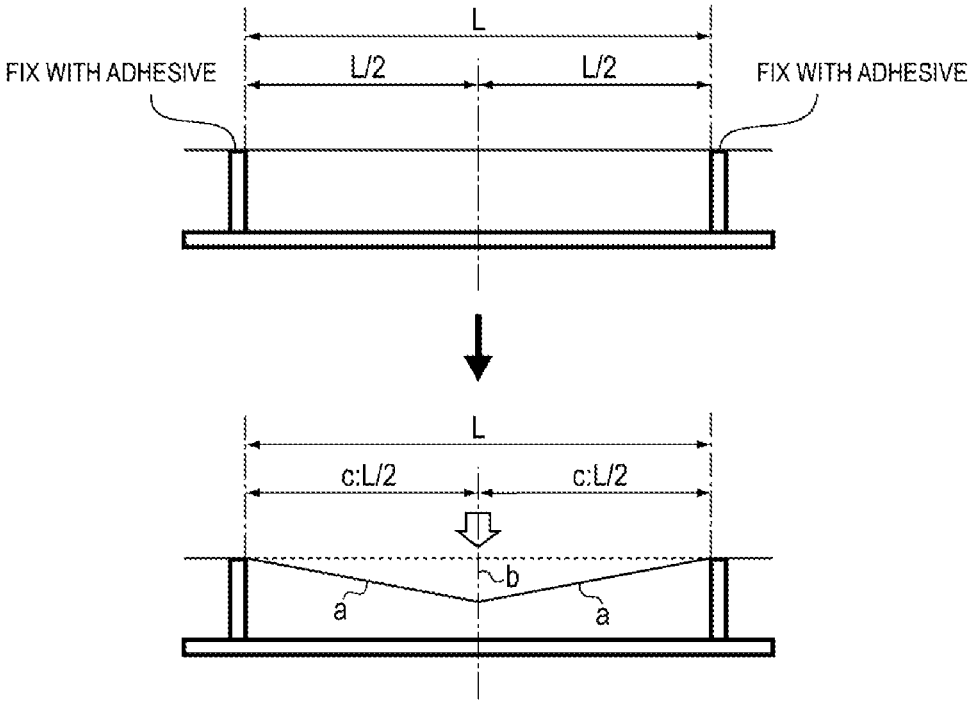
FIGS. 16A and 16B are figures for describing a tension measurement of a sheet member.
Figure 16B:
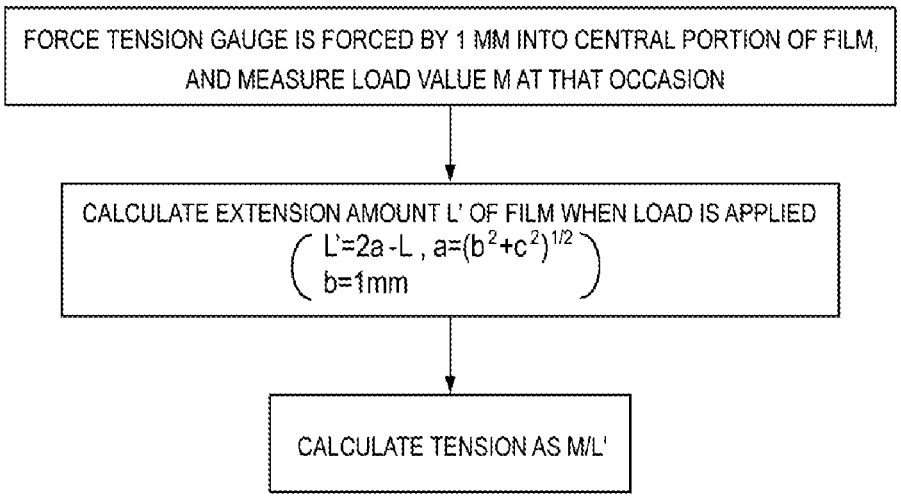

In the present invention, the tension of the sheet member 111 can be derived by performing measurement in a simplified manner as illustrated in FIGS. 16A and 16B. First, while the sheet member 111 is attached, a load M is measured when the tension gauge is forced into the sheet by 1 mm. At this occasion, an extension amount L' of the sheet member 111 defined in FIGS. 16A and 16B is measured. The tension is calculated from the value of M/L'. When the position where the tension gauge is forced into is measured in proximity to the rib where the sheet is fixed, the tension may not be measured correctly. For this reason, a distance L between fixing ends where both ends of the sheet member 111 are fixed is preferably 50 mm or more.

Two kinds, i.e., a polyethylene terephthalate (PET) film having a thickness of 130 μm and a polytetrafluoroethylene film (registered trademark Teflon) of fluorine resin made by Du Pont having a thickness of 200 μm are used for the sheet member 111 according to the present embodiment. However, the material and the thickness are not limited thereto, and it may be a film having a thickness of about 20 μm to 200 μm made by forming a high polymer component such as a generally-available synthetic resin into a thin film shape. The thickness of the film is preferably 20 to 500 μm, and more preferably, the thickness is 150 to 350 μm.

The sheet member 111 is made in such a manner that, after the fixing portion 112 is formed by applying an adhesive agent to the end of the rib 104 of the external cover 101, one end portion of the sheet member 111 is fixed, and the other end portion is fixed while a tension is given thereto by pulling it. The tension is given to the sheet member 111, and is fixed in a flat surface shape, so that the space 113 is formed.

Since it is sufficient to give a tension to the sheet member 111 to hold it, the fixing portion 112 may be provided on at least two ribs 104 at the opposite sides, i.e., at least ribs 104 at the upper side and the lower side of the external cover 101 and ribs 104 at the left side and the right side of the external cover 101. More specifically, the fixing portion 112 can be provided on at least the rib 104 (first rib portion) fixing the film along a first side of the film, and the rib 104 (second rib portion) fixing the film along a second side facing the first side of the film. In a case where a stronger tension is given to the sheet member 111 and in a case where the sheet member 111 is stably held in a flat manner, the fixing portion 112 may be provided on the ribs 104 at the outermost periphery and all the ribs 104.

The fixing portion 112 is not limited to the adhesive layer made with the adhesive agent. The fixing portion 112 may also be a welding layer made by using a thermoplastic film for the sheet member 111 and melting the film with heat to make welding by pressure application and cooling, or with a double-sided tape. In particular, in a case where there is no rib 104 on the external cover 101, the fixing portion 112 is made into a double-sided tape, so that the space 113 can be formed between the inner wall of the external cover 101 and the sheet member 111 because of the thickness of the double-sided tape.

The giving of the tension of the sheet member 111 is not limited to the present embodiment. For example, the sheet member 111 may be fixed while the tension is given thereto by pulling the both end portions or the periphery of the sheet member 111 in advance. In any method, the sheet member 111 may be fixed by applying the tension thereto.

Figure 8:
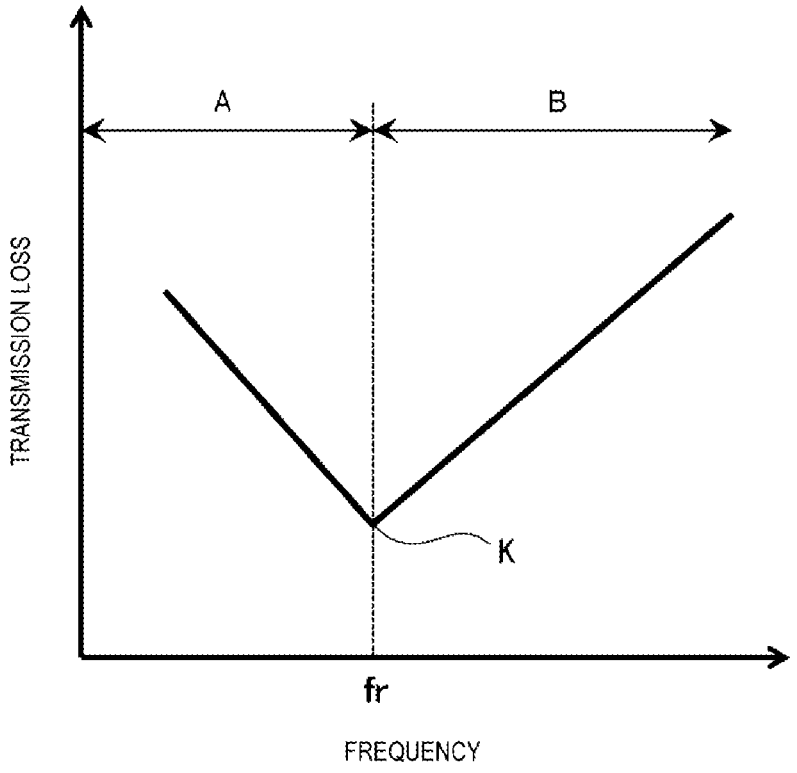
FIG. 8 is a graph in which a horizontal axis denotes a frequency, and a vertical axis denotes a transmission loss.

FIG. 8 is a graph in which the horizontal axis denotes a frequency and the vertical axis denotes a transmission loss. A viewpoint that leads to the configuration according to the present invention will be described with reference to this FIG. 8. In general, when a transmission sound is transmitted through a solid layer, a transmission loss (TL) is generated. In a case of a frequency region B which is larger than a primary oscillation frequency fr, the transmission loss (TL) is dependent on the mass law that is determined by only the mass regardless of the material of the solid layer. This transmission loss (TL) corresponds to the meaning of the sound insulation rate, and therefore, the transmission loss (TL) means the degree of difficulty in leakage of the sound. The transmission loss is expressed by the following expression (1).

$$TL=20\times\log(f\times M)-42.5\ [\mathrm{dB}] \quad (1)$$

The primary oscillation frequency fr in the expression (1) is a frequency [Hz], and M denotes an area density [kg/m$^2$] of the solid layer. The transmission loss of the panel body such as the external cover 101 also depends on the mass law, and it becomes less likely to vibrate as the area density (mass per unit area size) of the panel body increases, and therefore, as indicated by the above expression, in the frequency region B of FIG. 8, the higher the frequency is, the larger the transmission loss becomes. Since the panel body has a finite size, it has the primary oscillation frequency fr, and at that point, the panel body is likely to vibrate, and the transmission loss becomes small. A point K of the primary oscillation frequency fr is a point where the sound is most likely to be oscillated and leaked.

On the other hand, in the frequency region A equal to or less than the primary oscillation frequency fr, the ease of the vibration of the panel body depends on the rigidity of the panel body itself, and the transmission loss increases as the frequency of the incident sound wave becomes lower. This phenomenon is a law called rigidity law. Therefore, in order to obtain a large transmission loss without increasing the area density, which results in an increase of weight, i.e., without relying on the mass law, the rigidity may be increased to make it difficult to vibrate.

Therefore, the rigidity of the sheet member 111 is enhanced by giving a strong tension to the sheet member 111 provided on the external cover 101. Therefore, the primary oscillation frequency fr of the external cover 101 having the sheet member 111 shifts to the high frequency side. Therefore, the transmission sound can be reduced by making use of the rigidity law of the primary oscillation frequency fr or less. Therefore, when the transmission loss (sound insulation rate) is to be increased, the mass of the external cover 101 is increased, and the sound can be insulated by the area of the frequency region B. In contrast, when the rigidity of the external cover 101 is increased, the point of the primary oscillation frequency fr is shifted to the right, and the sound can be insulated (even if the mass is not increased) while the area of the frequency region A is increased.

It should be noted that the primary oscillation frequency fr of the external cover 101 having the sheet member 111 through giving of the tension can be found through measurement with a laser displacement gauge. The tension of the sheet member 111 can be found not only by the method described above but also by calculating with a theoretical expression of the primary oscillation frequency of the rectangular film by using a length of each side of the sheet member 111, the area density (mass per unit area size), and the measured primary oscillation frequency fr.

Subsequently, the effect of the external cover 101 having the sheet member 111 according to the present invention will be described. According to the mass law described above, when a high density material is used, the sound transmitted through the solid layer is attenuated, and the energy for vibrating the air layer at the opposite side is also attenuated, and accordingly, the transmission sound decreases. Therefore, as an example for comparing the effect of the present invention, an external cover 101 obtained by adding a mass to the external cover 101 as illustrated in FIGS. 9A and 9B was used.

Figure 9A:
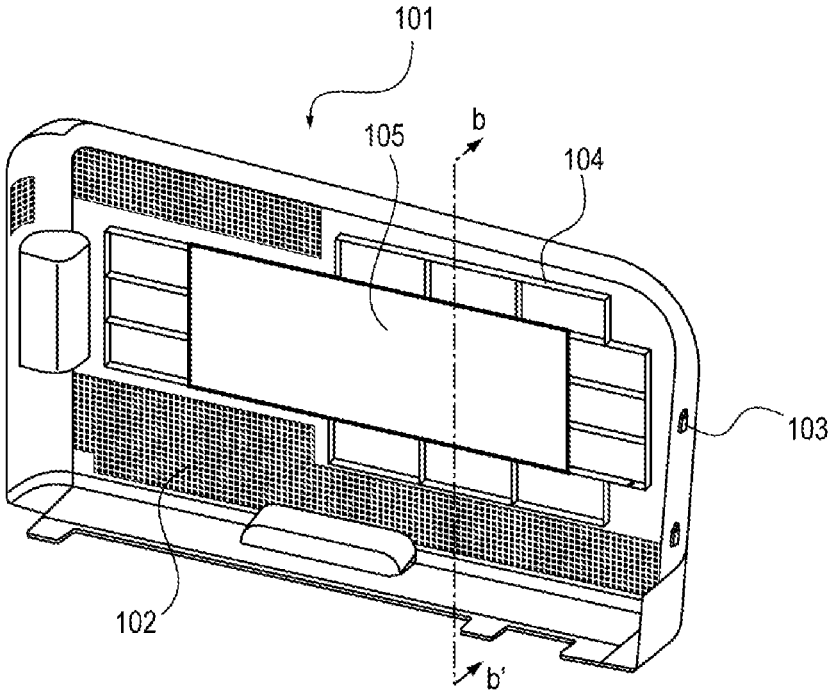
FIG. 9A is a perspective view illustrating a modification of an external cover.
Figure 9B:
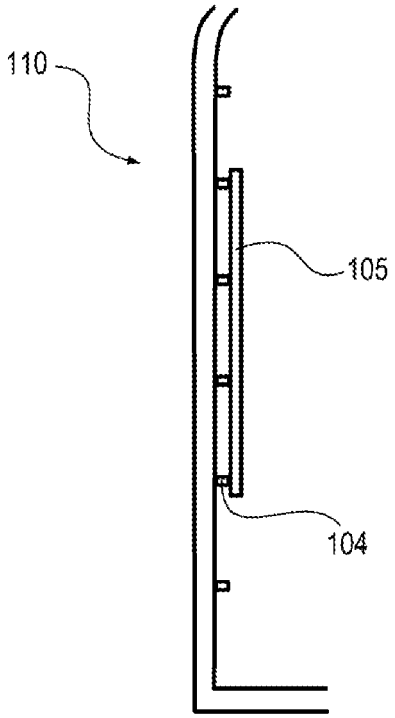
FIG. 9B is a cross sectional view illustrating a modification of an external cover.

FIG. 9A is a perspective view illustrating a modification of the external cover 101. FIG. 9B corresponds to a cross sectional view taken along line b-b' of FIG. 9A, and is a cross sectional view illustrating the modification of the external cover 101. In the modification of FIGS. 9A and 9B, the external cover 101 includes a cover main body 101A, and a sheet member 105 fixed to a rib 104 of the cover main body 101A with an adhesive agent.

The sheet member 105 is made of polyethylene terephthalate or a member having a higher rigidity than polytetrafluoroethylene. More specifically, the sheet member 105 is made of a zinc-plated steel plate. This sheet member 105 is a member having a size of 155 mm in the vertical direction and 170 mm in the horizontal direction, and the mass is adjusted by its thickness, so that a mass of about 200 g is obtained with the thickness of 1 mm, a mass of about 400 g is obtained with the thickness of 2 mm.

Figure 10:
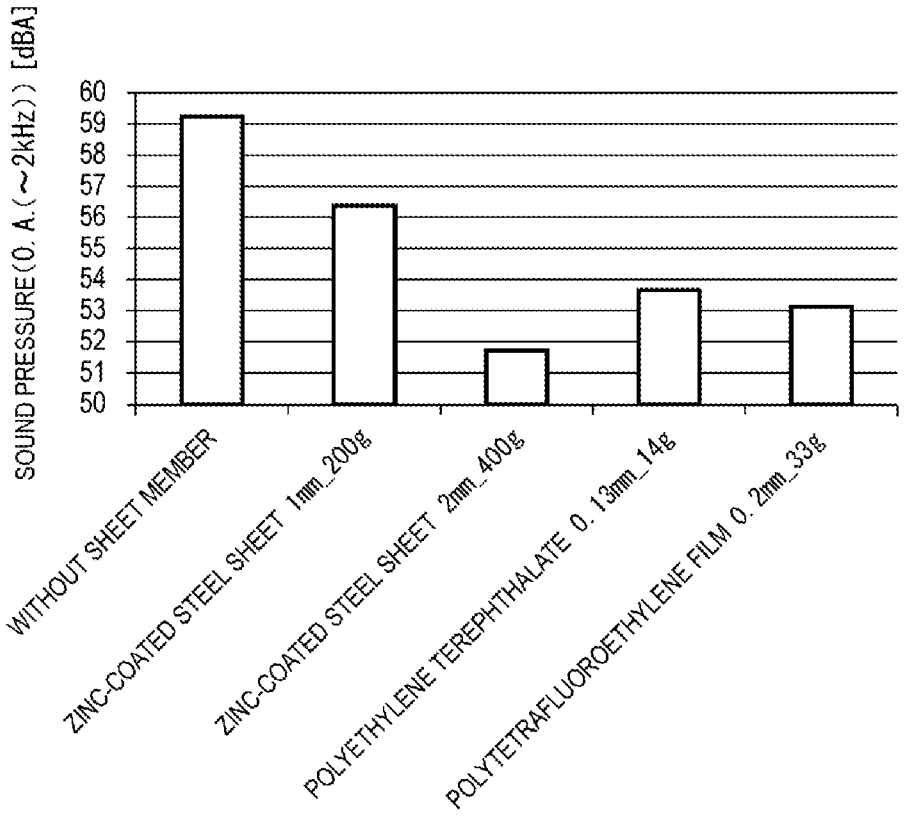
FIG. 10 is a graph illustrating sound pressure levels where external covers made of materials having different conditions are used.

FIG. 10 is a graph illustrating sound pressure levels of external covers 101 using sheet members 111 made of materials of which materials are different for the cover main body 101A. The effects of the present embodiment will be described with reference to the figure. Like FIG. 5, FIG. 10 illustrates, as an overall value up to 2 kHz, a sound pressure level obtained when the image forming apparatus 100 according to the present embodiment is operated in the monochrome mode. First, the effect caused by mass loading will be described.

When the sheet member 111 provided on the cover main body 101A uses a member made of a zinc-coated steel sheet of which thickness is 1 mm and of which mass is 200 g, the sound pressure level was reduced by about 2.9 dB as compared with the configuration in which the sheet member 111 is not provided on the cover main body 101A. When the sheet member 111 provided on the cover main body 101A uses a member made of a zinc-coated steel sheet of which thickness is 2 mm and of which mass is 400 g, the sound pressure level was reduced by about 7.5 dB as compared with the configuration in which the sheet member 111 is not provided on the cover main body 101A.

On the other hand, when the sheet member 111 provided on the cover main body 101A uses a member made of a PET sheet of which thickness is 0.13 mm and of which mass is 14 g, the sound pressure level was reduced by about 5.6 dB as compared with the configuration in which the sheet member 111 is not provided on the cover main body 101A. When the sheet member 111 provided on the cover main body 101A uses a member made of a polytetrafluoroethylene sheet of which thickness is 0.2 mm and of which mass is 33 g, the sound pressure level was reduced by about 6.1 dB as compared with the configuration in which the sheet member 111 is not provided on the cover main body 101A. When estimating from the result of mass loading, the sheet member 111 made of the PET sheet and the polytetrafluoroethylene sheet achieves the effects equivalent to those having mass of 300 g. More specifically, the same sound pressure reduction effects can be obtained with a mass loading as small as about 1/10 to 1/20 of a generally-available mass loading.

Figure 11:
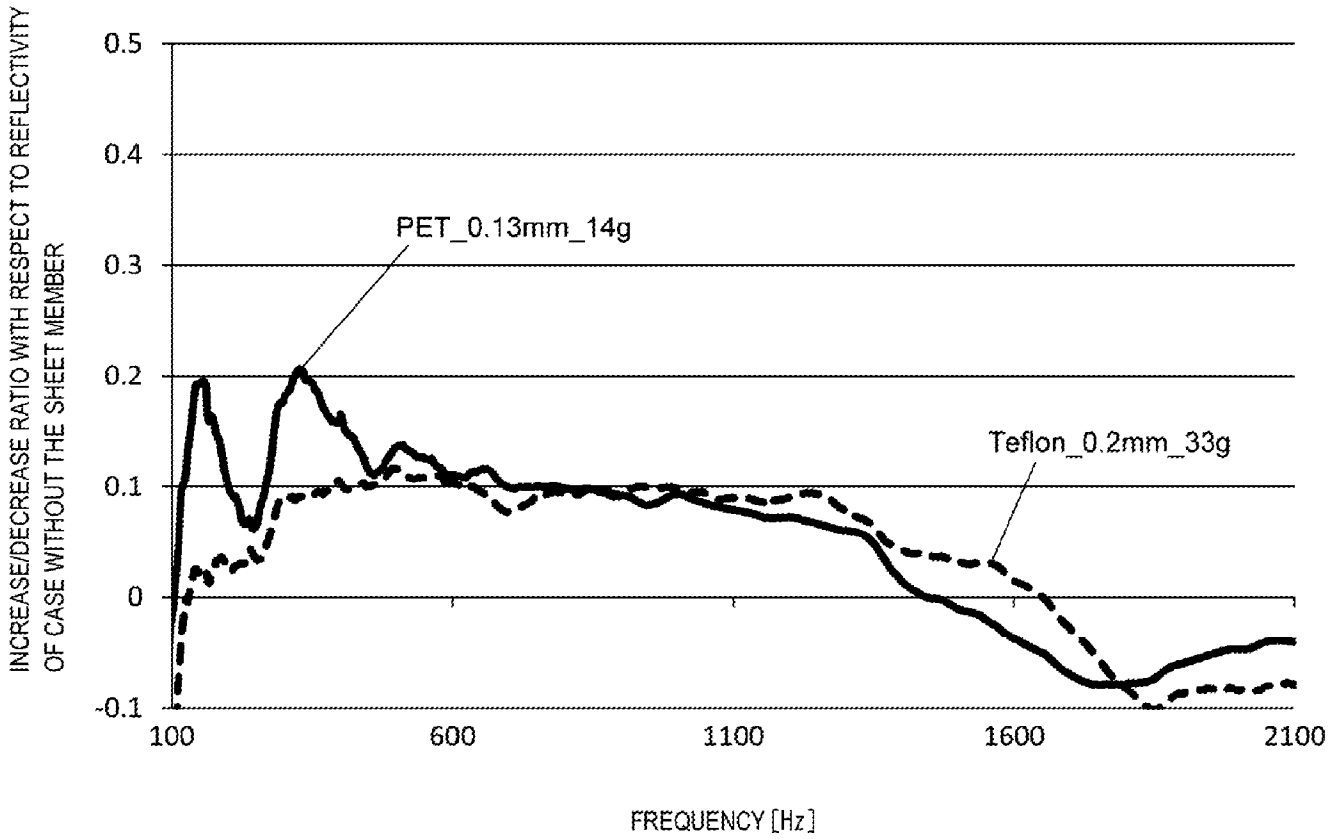
FIG. 11 is a graph in which the horizontal axis denotes a frequency and the vertical axis denotes an increase/decrease ratio with respect to the reflectivity of an external cover without any sheet member.

FIG. 11 is a graph in which the horizontal axis denotes a frequency and the vertical axis denotes an increase/decrease ratio with respect to the reflectivity of the external cover 101 without the sheet member 111. The measurement result of the reflectivity will be described with reference to FIG. 11. Since it is difficult to directly measure the transmission loss of the external cover 101 having the sheet member 111 according to the present invention, the sound insulation performance is evaluated by measuring the reflectivity in this case. The energy (I) incident upon the external cover 101 having the sheet member 111 is considered to be a summation of a reflected wave energy (R), a transmission wave energy (T), and an absorbed energy (r). Therefore, the transmission energy (T) can be expressed by the following expression.

$$T=I-R-r \quad (2)$$

When the reflected wave energy (R), i.e., the reflectivity (R/I), is high, the transmission energy (T) decreases, and therefore, the sound pressure level transmitted through the external cover 101 is also reduced. Therefore, the sound insulation performance can be evaluated in a simplified manner from the measurement of the reflectivity. For the measurement of the reflectivity, a surface impedance measurement system produced by Microflown Technologies was used. An external cover 101 using a PET sheet for the sheet member 111 and an external cover 101 using a polytetrafluoroethylene sheet for the sheet member 111 were used. In this case, in a frequency region of 100 Hz to 1.5 kHz, the reflectivity became higher than those with only the cover main body 101A of the external cover 101, and it was confirmed that the sound insulation performance was improved.

Figure 12A:
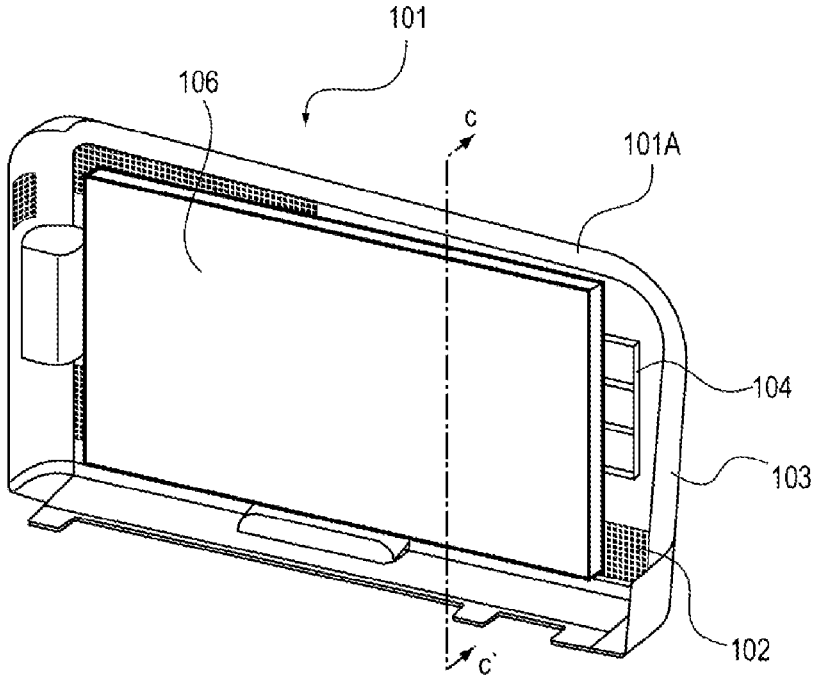
FIG. 12A is a perspective view illustrating an external cover according to a comparative example.
Figure 12B:
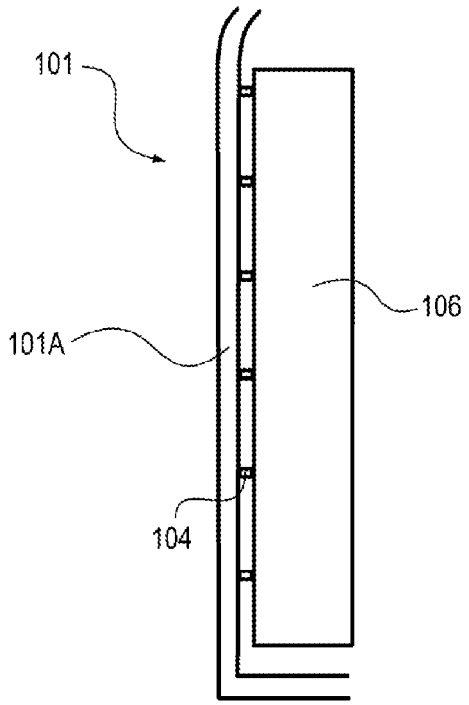
FIG. 12B is a cross sectional view illustrating an external cover according to the comparative example.

Subsequently, a comparison will also be made with an external cover 101 using a generally-available acoustic material 106 with reference to FIGS. 12A, 12B and 13. FIG. 12A is a perspective view illustrating an external cover 101 according to a comparative example. FIG. 12B corresponds to a cross sectional view taken along line c-c' of FIG. 12A, and is a cross sectional view illustrating the external cover 101 according to the comparative example. In this case, an acoustic material (1) and an acoustic material (2) were used.

The acoustic material (1) is made into a sponge form with urethane foam, and in this case, the acoustic material (1) is made with a thickness of 10 mm and a mass of 7.2 g. The acoustic material (2) is a member in which, when an external force is not given, a special additive exists in a stable state in such a manner that the special additive is attracted by a high polymer main chain with electrical charge, and when an external force is given, the special additive binds the movement of the high polymer main chain to greatly convert it into a friction. In this case, the acoustic material (2) was configured to have a thickness of 10 mm and a mass of 22.5 g. As is evident from FIG. 13 described later, the acoustic material (2) is a member having a superior vibration suppression performance than the acoustic material (1) and having a high sound absorption rate even at a low frequency. The acoustic materials (1), (2) are adhered to substantially the entire inner wall surface of the cover main body 101A, so that the acoustic materials (1), (2) have masses close to that of the sheet member 111 according to the present embodiment.

Figure 13:
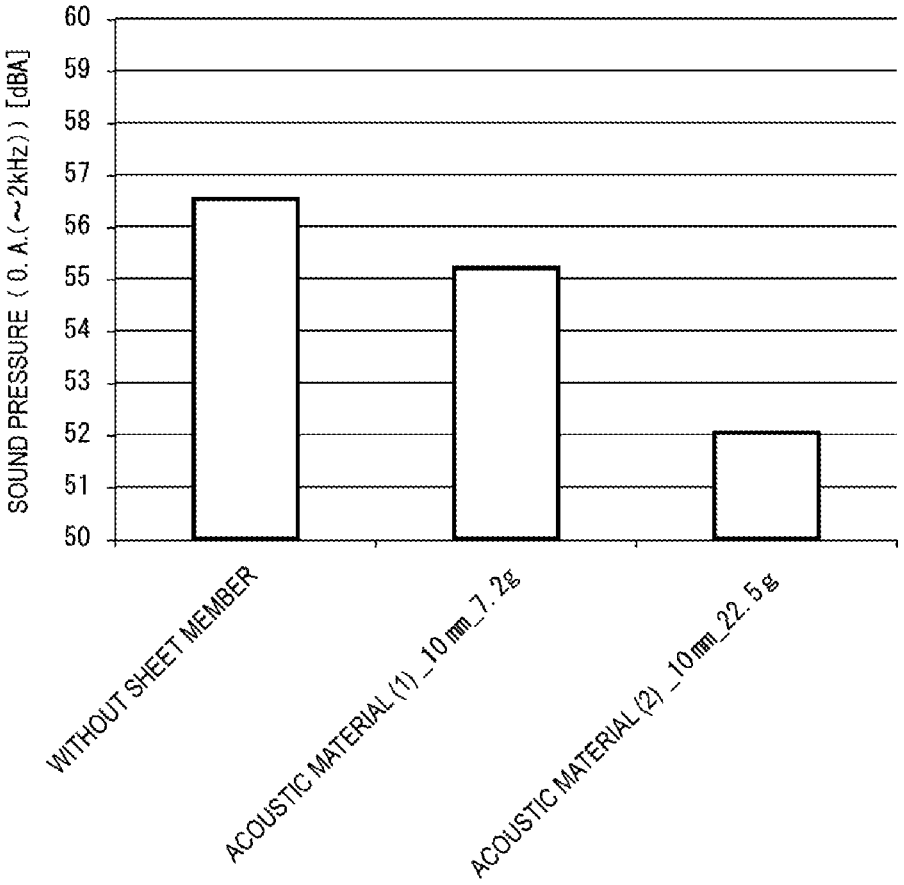
FIG. 13 is a graph illustrating sound pressure levels where external covers made of materials having different conditions according to a comparative example are used.

FIG. 13 is a graph illustrating sound pressure levels where external covers 101 made of materials having different conditions of materials according to the comparative example are used. Like FIGS. 5 and 10, this FIG. 13 illustrates, as an overall value up to 2 kHz, a sound pressure level when operated in the monochrome mode. The external cover 101 having the acoustic material (1) has a sound pressure level that is 1.3 dB lower than the configuration of the external cover 101 without any sheet member 111, and the external cover 101 having the acoustic material (2) has a sound pressure level that is 4.5 dB lower than the configuration of the external cover 101 without any sheet member 111.

In a case where the acoustic material 106 is used, even the acoustic material 106 having a thickness of 10 mm which is 50 to 80 times thicker than the sheet member 111 used in the present embodiment provides a lower level of sound pressure reduction effect than the external cover 101 according to the present invention. When the acoustic material 106 is made to be thicker, a further sound pressure reduction effect can be expected, but, for example, when a distance of a space between the driving unit 200 and the external cover 101 in the image forming apparatus 100 according to the present embodiment is considered, it is practically difficult to dispose an acoustic material 106 having a thickness of 10 mm or more.

As described above, the transmission sound of the external cover 101 was reduced with a very small mass loading and thickness increase caused by only the sheet member 111 on the external cover 101 of the image forming apparatus.

[Second Embodiment]

Figure 14A:
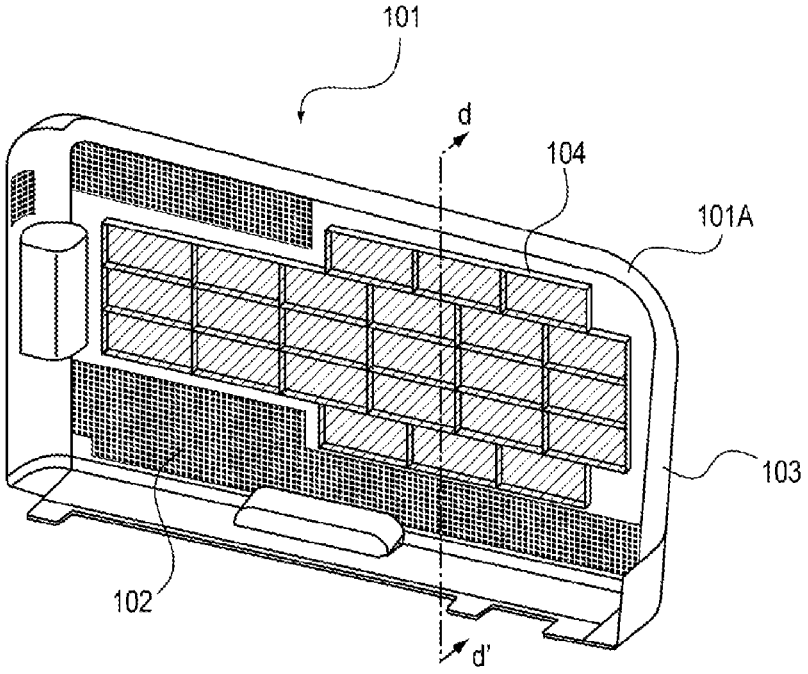
FIG. 14A is a perspective view illustrating an external cover according to a second embodiment of the present invention.
Figure 14B:
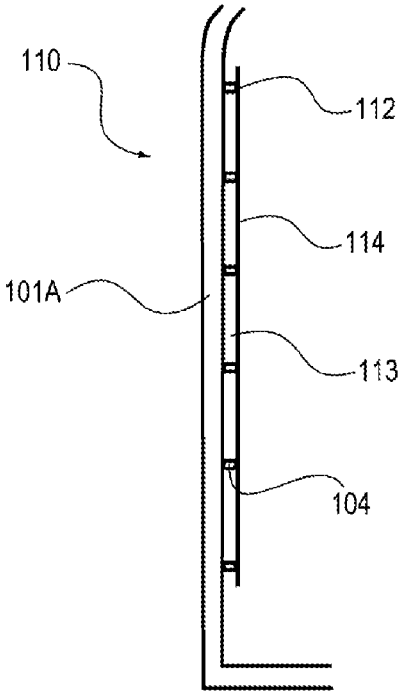
FIG. 14B is a cross sectional view illustrating an external cover.

Subsequently, the second embodiment according to the present invention will be described with reference to FIGS. 14A and 14B. In the present embodiment, only the items different from the first embodiment described above will be described, and the same constituent elements as those of the first embodiment will not be described. FIG. 14A is a perspective view illustrating an external cover 101 having a thermal shrinkage sheet 114 serving as a "sheet member" according to the second embodiment of the present invention. FIG. 14B corresponds to a cross sectional view taken along line d-d' of FIG. 14A, and is a cross sectional view illustrating the external cover 101 having the thermal shrinkage sheet 114 according to the second embodiment of the present invention.

In the present embodiment, the thermal shrinkage sheet 114 is used as the sheet member. The thermal shrinkage sheet 114 has a thermal shrinkage performance, and after it is fixed to the cover main body 101A, a tension is given to the thermal shrinkage sheet 114 through thermal shrinkage. The thermal shrinkage sheet 114 (HSf; Heat Shrinkable films) means a film that shrinks when a certain level of heat is applied thereto after the film is extended at a low temperature. In this case, the "tension giving portion" corresponds to the rib 104 and a portion to which the heat is applied.

A two-direction shrinking type thermal shrinkage sheet 114 having a thickness of 20 μm is provided on the cover main body 101A of the external cover 101, and the fixing portion 112 is provided on all the ribs 104, and they are fixed according to the method described in the first embodiment. The thermal shrinkage sheet 114 is shrunk by applying a heat gun after being fixed. By using this shrinking property, a further tension is given to the thermal shrinkage sheet 114. In the present embodiment, the heat gun is applied to the entire thermal shrinkage sheet 114, so that the entire thermal shrinkage sheet 114 is shrunk.

However, the heat gun may be applied to only a limited portion of the thermal shrinkage sheet 114 fixed to the fixing portion 112, so that the thermal shrinkage sheet 114 can be shrunk at any given position to give a tension. Therefore, in accordance with the sound source position that occurs in the inside of the image forming apparatus, the position where the tension is given can be adjusted in any manner.

Figure 15:
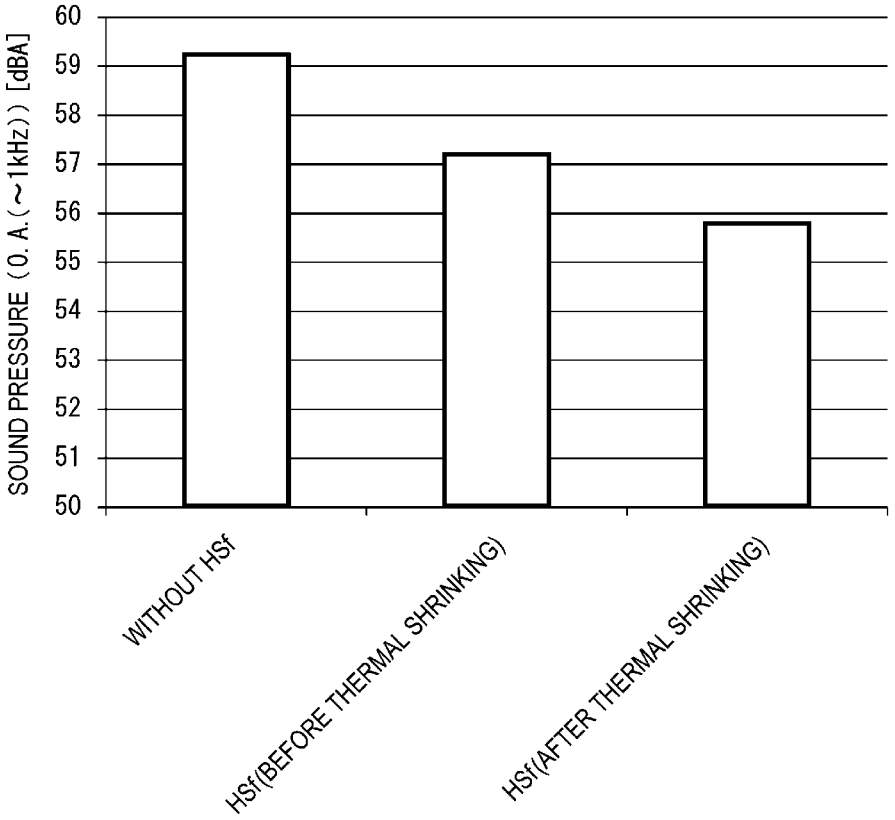
FIG. 15 is a graph illustrating sound pressure levels where external covers made of materials having different conditions according to the second embodiment are used.

FIG. 15 is a graph illustrating sound pressure levels where external covers made of materials having different conditions according to the second embodiment are used. The effects of the present embodiment will be described with reference to this FIG. 15. Like the description of the first embodiment, FIG. 15 illustrates, as an overall value up to 1 kHz, a sound pressure level obtained when the image forming apparatus is operated in the monochrome mode. As compared with the external cover 101 without any thermal shrinkage sheet 114, the sound pressure level decreased by about 2 dB before the thermal shrinkage, and the sound pressure level further decreased by about 3.6 dB after the thermal shrinkage. As described above, with the external cover 101 according to the present embodiment, the sound pressure reduction effect can be further improved by further giving a tension by using the thermal shrinkage.

According to the configuration of the first embodiment, the sound insulation performance can be improved while realizing a thin thickness and a light weight of the external cover 101 without using any acoustic material for the external cover 101 of the image forming apparatus 100 and without using any resonance space, any frame body, a curvature rate of a film, or an air pressure.

According to the present embodiment, the sheet 111 uses a sheet that does not have any air permeability, but, for example, a fibrous sheet having air permeability may also be applied thereto. However, the sheet that does not have any air permeability in the sheet itself is more preferable since the sound insulation performance can be improved.

According to the present embodiment, the sound insulation performance can be improved while the cover is made into a thin thickness.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-197956, filed Oct. 5, 2015 which is hereby incorporated by reference herein in its entirety.

What is claimed is:

1. An image forming apparatus, comprising:

a main body configured to accommodate an image forming portion which forms an image on a recording material;

a cover which is provided on the main body and covers the image forming portion;

a driving unit which is provided on the main body and drives the image forming portion; and a film attached to the cover with a gap formed against an inner wall of the cover, the film facing the inner wall of the cover while a tension is given thereto and without coming into contact with the driving unit.

2. The image forming apparatus according to claim 1, wherein a thickness of the film is equal to or more than 20 μm and equal to or less than 500 μm.

3. The image forming apparatus according to claim 1, wherein a tension of the film is equal to or more than 1 kgf/cm and equal to or less than 100 kgf/cm.

4. The image forming apparatus according to claim 1, wherein the film is a resin.

5. The image forming apparatus according to claim 1, wherein the film has a thermal shrinkage property, and a tension is given thereto through thermal shrinkage after being fixed to the cover.

6. The image forming apparatus according to claim 1, wherein the cover includes a first rib portion protruding from the inner wall of the cover and fixing the film along a first side of the film and a second rib portion protruding from the inner wall of the cover and fixing the film along a second side facing the first side of the film.

7. The image forming apparatus according to claim 1, wherein the film is made of polyethylene terephthalate or polytetrafluoroethylene.

* * * * *